United States Patent [19]

Lacy, Jr. et al.

[11] 4,311,241

[45] Jan. 19, 1982

[54] METHOD FOR SEPARATING CLODS AND THE LIKE FROM POTATOES

[75] Inventors: F. Hilton Lacy, Jr., Houston, Tex.; Christopher H. Weis, Salt Lake City, Utah

[73] Assignee: Lockwood Corporation, Gering, Nebr.

[21] Appl. No.: 93,269

[22] Filed: Nov. 13, 1979

[51] Int. Cl.[3] ..... B07C 5/344

[52] U.S. Cl. ..... 209/570; 209/640; 209/656

[58] Field of Search ..... 209/567, 570, 638, 640, 209/642, 656, 657, 571; 324/239, 243, 71

[56] References Cited

U.S. PATENT DOCUMENTS

| | | | |
|---|---|---|---|
| 2,228,293 | 1/1941 | Wurzbach | 324/243 X |
| 2,290,930 | 7/1942 | Wurzbach | 324/239 |
| 3,268,073 | 8/1966 | Lehde | 209/567 |

FOREIGN PATENT DOCUMENTS

| | | | |
|---|---|---|---|
| 58411 | 10/1967 | Fed. Rep. of Germany | 209/657 |
| 1914530 | 8/1970 | Fed. Rep. of Germany | 209/571 |
| 401408 | 11/1972 | U.S.S.R. | 209/571 |

*Primary Examiner*—Allen N. Knowles

[57] ABSTRACT

Method for separating clods and the like from potatoes, which includes placing the clods and potatoes on a first belt for transporting the potatoes and clods toward a forward end and positioning a second belt spaced horizontally apart from and vertically lower than the end of the first belt such that potatoes leaving the end travel through the air and land on the second belt. The clods are detected by a detector that includes a magnet and a coil positioned in the field of the magnet. The clods are removed from the system by a normally flaccid inflatable finger positioned between the forward end of the first belt and the second belt. When the detector signals the presence of a clod, air is supplied to the finger causing the stiffening thereof, which deflects the trajectory of the clod causing it to fall between the forward end and the second belt.

7 Claims, 7 Drawing Figures

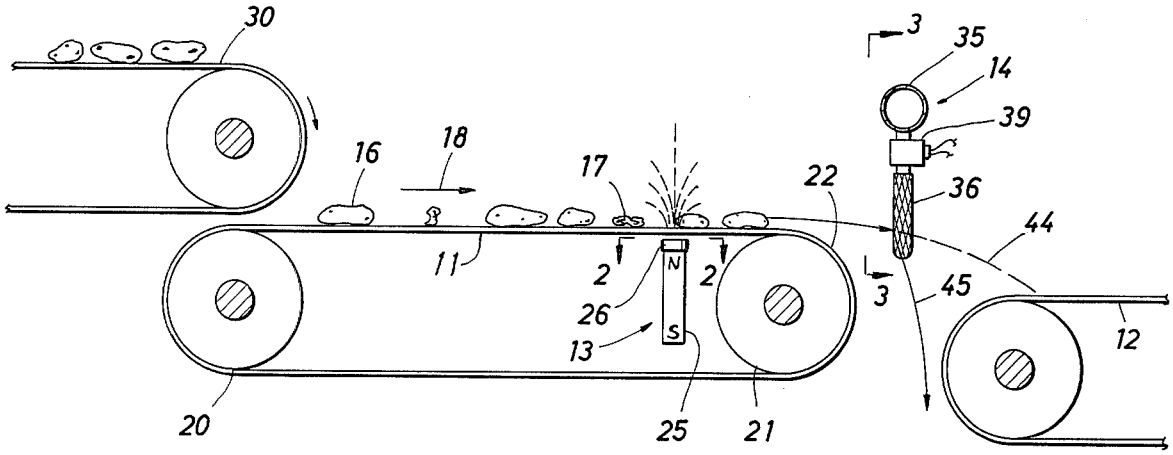
FIG. 1
FIG. 3
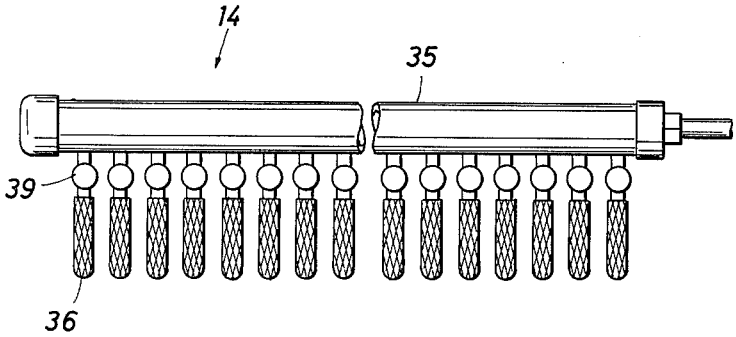
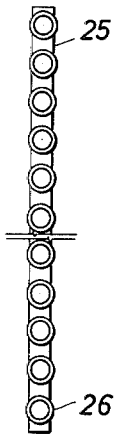
FIG. 2
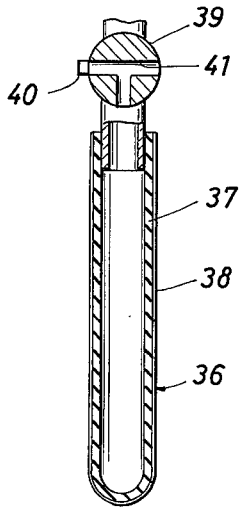
FIG. 4

METHOD FOR SEPARATING CLODS AND THE LIKE FROM POTATOES

BACKGROUND OF THE INVENTION

A. Field of the Invention

This invention relates to separating methods, and more particularly to an electromechanical method for separating clods and the like from potatoes.

B. Description of the Prior Art

In the process of mechanically harvesting potatoes, considerable numbers of clods are excavated therewith. The prior art has attempted to separate these clods from potatoes by various means, including specific gravity differences, form and shape differences, rolling differences, and electro-magnetic differences. For example, in U.S. Pat. No. 2,467,773 sorting was attempted by using the difference in ohmic conductivity of clods and potatoes by piercing the peels of the potatoes with needles, knives, or the like, which causes subsequent premature rotting of the potatoes.

A number of methods have been proposed whereby the potatoes and clods must be transported one by one in single file fashion for detection and subsequent ejection. In some of these proposals it was still necessary to make electric contact with the potatoes and clods, for example U.S. Pat. No. 3,578,160, which is mechanically difficult and which can cause bruising or piercing of the potato and subsequent rotting. A newly harvested potato is quite often covered with a layer of dirt or soil of substantially the same chemical composition as the clods. Thus any mechanical device that must penetrate the soil layer to make electrical contact with the potato may bruise the potato or penetrate the skin or peel of the potato, causing the potato to rot. Penetrating the skin of the potato not only can cause it to rot but can give spurious or false signals from a device which is designed or intended only to make electrical contact with the skin. This occurs because the interior of the potato is of comparatively low ohmic conductivity. Clods vary quite markedly in their ohmic conductivity depending on the chemical composition of the clod and its water content.

Among the proposals to marshal and transport potatoes one by one in a single file are those disclosed in U.S. Pat. Nos. 3,200,888 and 3,268,073. After such marshaling and transporting single file, the objects are dropped one by one through a tube containing a sensing ring which has an oscillator driving such ring. A comparatively electrically conductive object such as a potato reduces the amplitude of the oscillations of the coil as compared to the amplitude of the oscillations when no object or an object of comparatively low conductivity such as a stone or clod is dropped through the sensing coil or ring. The reduced amplitude of the coil oscillating frequency allows detection of a potato and subsequently through magnetic clutches, brakes, and kicker plate mechanisms to advance the potato while rejecting stones, clods and the like.

Making potatoes and clods move in a single file, one by one, is inherently mechanically difficult and expensive. In addition, dropping potatoes any significant distance can subject them to bruising, even if cushioning devices are used. Magnetic brakes, clutches, and kicker plates are inherently slow-acting devices allowing only a relatively slow separation of objects in each file or singulated channel or passageway. This causes a comparatively large machine to be required with a large number of single-file rows with attendant complexity and expense to handle a high volume of potatoes and clods and separate them efficiently. Because of the highly variable nature of a clod's conductivity, depending on its chemical composition and water content, it is common for a detecting device that depends solely on conductivity differences to give spurious responses and rejections when a clod's conductivity approaches that of a potato.

Because the prior art has failed to provide reliable, relatively simple, and economical means to separate clods and potatoes, manual means of separation are still today the state of the art with many workers busily engaged in rejecting clods from potatoes.

SUMMARY OF THE INVENTION

It is therefore an object of the present invention to provide a method which can economically mechanically separate large volumes of clods from potatoes.

It is a further object of the present invention to provide a method that can effectively and economically mechanically separate potatoes and clods without marshaling them or requiring that the potatoes and clods be made to singulate or go down discreet channels, aisles, or passageways.

It is a further object of the present invention to provide a method for separating clods from potatoes that does not require mechanical or electrical contact by the detector or require any substantial drop and resultant bruising of the potatoes.

It is well known that all soils in which potatoes are grown contain some quantities of iron in various forms. Some of such iron may have been applied in the form of fertilizer, for example, ferrous sulphate. Some of such iron occurs naturally in the soil in the form of relatively strong magnetic matter, for example, magnetite, ilmenite and metallic iron. Some of such iron occurs as weakly magnetic material, such as hornblende, tourmaline, garnet, hematite, limonite, and biotite. Soils also contain some amounts of various conductive materials, and depending on the water content, vary greatly in their conductivity.

A potato, by contrast, contains very small quantities of iron even in the skin, and is very nonconductive in the skin and only moderately conductive in the interior. The present invention takes advantage of these electromagnetic differences to provide a potato/clod sorting method that overcomes the shortcomings of the prior art. Briefly stated, the method of the present invention includes supporting and conveying the potatoes and clods substantially horizontally at a substantially constant speed toward a forward end of a belt, and positioning a second belt spaced horizontally apart from and vertically lower than the forward end of the first belt such that potatoes leaving the forward end of the first belt travel through the air and land on the second belt. The vertical distance between the first belt and the second belt is small enough that the potatoes are not injured by the fall.

The clods are detected by a plurality of detectors positioned across the first belt perpendicular to the direction of travel of the potatoes and clods. The detectors comprise a magnet and a coil positioned in the field of the magnet. A clod passing near the detector affects the field associated with the magnet and causes the field to vary with time. This time-varying field includes a signal in the coil, which resembles one cycle of a sine wave. It has been found that all clods produce a detectable signal. By contrast, a potato produces a zero or negligible signal which is lost in the noise and is substantially not detectable.

Clods are ejected by means of a plurality of normally flaccid inflatable fingers positioned between the forward end of the first belt and the second belt in the trajectory of the clods and potatoes traveling therebetween. Each finger corresponds and is electronically associated with a particular coil. Potatoes leaving the forward end of the first belt hit the flaccid fingers, but are not significantly deflected thereby and land on the second belt. However, means responsive to the signal generated by a clod are provided for inflating and thereby stiffening the fingers which slow down the clods and cause them to fall between the endless belts. Because of the horizontal separation between the coils and the fingers, means are provided for delaying the inflation of the fingers during the time required for clods to travel between the coils and the fingers.

BRIEF DESCRIPTION OF THE DRAWINGS

FIG. 1 is a side elevation view showing the mechanical elements of the apparatus of the preferred embodiment of the invention.

FIG. 2 is a view taken along line 2—2 of FIG. 1 showing the arrangement of the coils and magnet.

FIG. 3 is a view taken along line 3—3 of FIG. 1 showing the air manifold and fingers.

FIG. 4 is a partial sectional view of one finger.

DESCRIPTION OF THE PREFERRED EMBODIMENT

Figure 5:
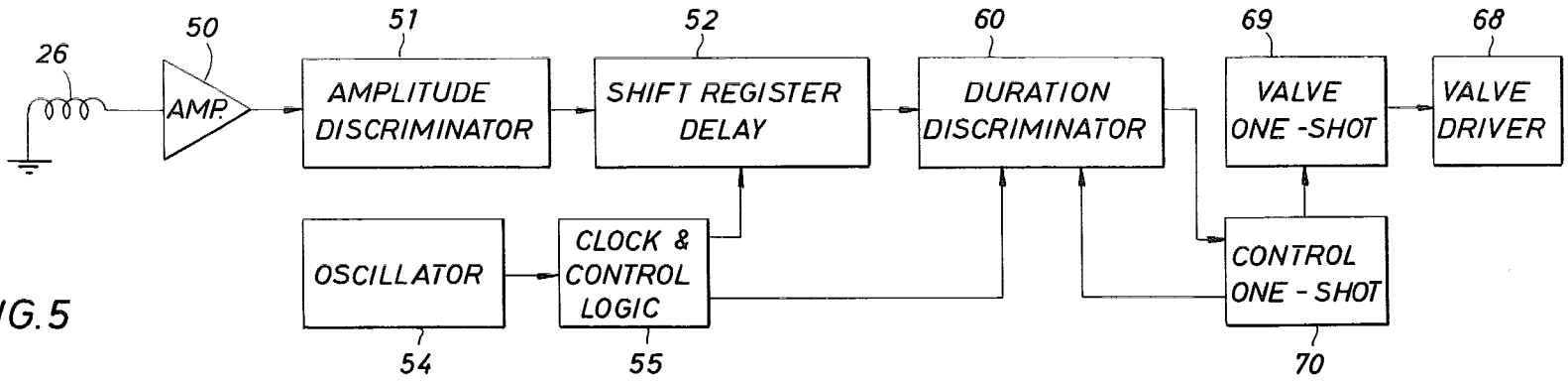
FIG. 5 is a block diagram showing the principal electronic components of the preferred embodiment of the present invention.

Referring first to FIG. 1, the mechanical elements of the present invention include generally a first belt 11, a second belt 12, a clod detector 13, and clod rejecting means 14.

First belt 11 is arranged for rotation about a pair of cylinders 20 and 21 in order to convey potatoes 16 and clods 17 in the direction of arrow 18 toward a forward end 22. Means (not shown) are provided for rotating cylinders 20 and 21 at a substantially constant speed. A substantially constant speed of rotation is desirable because of the horizontal spacing between clod detector 13 and clod rejecting means 14. Means, which will be described in detail hereafter, are provided for delaying the actuation of clod rejecting means 14 after the clod that is to be rejected has been detected by clod detector 13. The length of the time delay is determined by the distance between detector 13 and rejecting means 14 and the speed of belt 11. A constant speed of rotation of cylinders 20 and 21 is also desirable in order to make more uniform the trajectories of potatoes and clods traveling between forward end 22 and belt 12. A constant speed of rotation is also desirable in order to make more uniform the frequency of signals generated by clods 17.

Belt 11 should preferably be long enough to enable the clods and potatoes to become stable thereon, i.e., not bouncing or rolling, prior to reaching detector 13. The width of belt 11 should be sufficient to allow the potatoes and clods to be spread thereover in a monolayer, and not on top of each other. In the preferred embodiment, clods and potatoes are delivered to belt 11 by a third belt 30 that may or may not be driven at substantially the same speed as belt 11. Belt 30 may be driven electrically.

Clod detector 13 includes a magnet 25 and a coil 26. In the preferred embodiment, magnet 25 is a bar magnet substantially as wide as belt 11 and polarized such that the upper surface thereof is of one pole and the lower surface is of the other. It will of course be recognized that magnet 25 may comprise a plurality of individual magnets. A permanent magnet is preferred over an electromagnet because it produces a uniform field that does not vary significantly with time. As shown in FIG. 2, a plurality of coils 26 are spaced across the top of magnet 25. The diameter and spacing of coil 26 are determined by the size of the smallest clods to be encountered. Clods smaller than the smallest desired potatoes can be removed from the system prior to disposition on belt 11 by conventional grading apparatus. When a clod 17 passes over coil 26, the strength of the magnetic field in the vicinity of coil 26 is affected, which causes a current to be induced in coil 26. The signal induced in coil 26 resembles one cycle of a sine wave, the amplitude thereof depending upon the size and the magnetic and conductive properties of the clod and the frequency thereof depending upon the speed of travel of belt 11. When a potato passes over a coil 26, at most only a feeble signal is induced, which goes undetected by the amplitude discriminator, to be described hereinafter. It will of course be recognized that coil 26 and magnet 25 may be positioned on opposite sides of belt 11, as for example with magnet 25 positioned above belt 11 and coil 26 below.

Clods are rejected by means of clod rejecting means 14, which includes an air manifold 35 that is connected to an air supply (not shown), and a plurality of normally flaccid inflatable fingers 36. Each finger 36 corresponds to and is associated with a coil 26 and the spacing of fingers 36 is substantially the same as the spacing of coils 26.

Referring to FIG. 4, each finger 36 includes an elastomeric sleeve 37 covered by a fabric sleeve 38. Fabric sleeve 38 is provided in order to keep elastomeric sleeve 37 from bulging and to make finger 36 more wear-resistant. The volume of finger 36 is preferably small in order to minimize the inflation and deflation time, and the quantity of air required.

Air from air manifold 35 is connected to finger 36 by a solenoid-operated three-way valve 39. When the presence of a clod is detected by a particular coil 26, the electronics, to be described hereafter, signal the valve 39 of the finger 36 corresponding to that coil 26 to open an airline 41 from air manifold 35 and admit air into finger 36. After a preselected amount of time, valve 39 is signaled to close airline 41 and open a vent port 40 and thereby vent finger 36 to the atmosphere. Potatoes leave forward end 22 and travel in the trajectory designated by the numeral 44. When a potato hits a flaccid finger 36, its trajectory 44 is not significantly affected and it lands on belt 12 and is conveyed away. However, when a clod hits a stiffened finger 36, its trajectory, designated by the numeral 45, is substantially deflected causing the clod to fall between forward end 22 and belt 12.

Turning now to FIG. 5, the signal from coil 26 is first amplified by amplifier 50. In the preferred embodiment, amplifier 50 comprises a two-stage operational amplifier with associated components. The first stage of amplifier 50 is an inverting stage with a very low input impedance, and may consequently be considered to be a current-to-voltage converter. The second stage of amplifier 50 has a voltage gain adjustable over a range preferably from 100 to 500. The time constants of the feedback circuits and interstage and output coupling circuits are preferably selected to attenuate frequencies above and below the relatively narrow band occupied by legitimate clod signals.

The output from amplifier 50 is input to an amplitude discriminator 51 that produces a logical true output when the output signal of amplifier 50 exceeds a preset level. Noise, potatoes, or clods of insignificant size produce signals that are too small to trigger the output of amplitude discriminator 51.

In order to delay the stiffening of finger 36 until a clod travels from detector 13 to rejector 14, the output of amplitude discriminator 51 is loaded into delay 52. In the preferred embodiment, delay 52 comprises a serial shift register that is clocked at 1 millisecond intervals by a clock signal. For example, if amplitude discriminator 51 output is true for 7.5 milliseconds, then a 7 millisecond pulse will be loaded into and moved down delay 52 at a rate of one step per millisecond. The number of steps in delay 52 is determined by the length of time necessary for a clod to travel from detector 13 to rejector 14. For example, if the required delay time is 120 milliseconds, 120 steps are provided and a pulse loaded into such a delay will emerge 120 milliseconds later with its length preserved to the nearest millisecond. Several pulses may be in shift register delay 52 at any time and the delay time may be altered by changing the number of stages in the shift register or by changing the clock rate.

Figure 6:
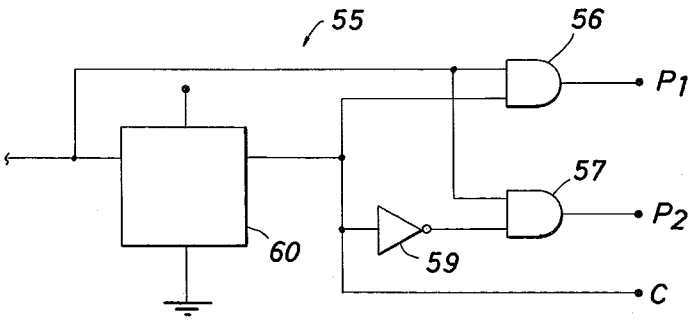
FIG. 6 is a diagram of the clock and control logic circuit.

The clock and control logic circuit designated generally by the numeral 55 is illustrated in detail in FIG. 6. In the preferred embodiment, one-Khz clock signal C is produced by dividing by two the output of two-Khz oscillator 54 with ripple counter 60. Clock signal C is used to load shift register delay 52 in the manner previously described.

Figure 7:
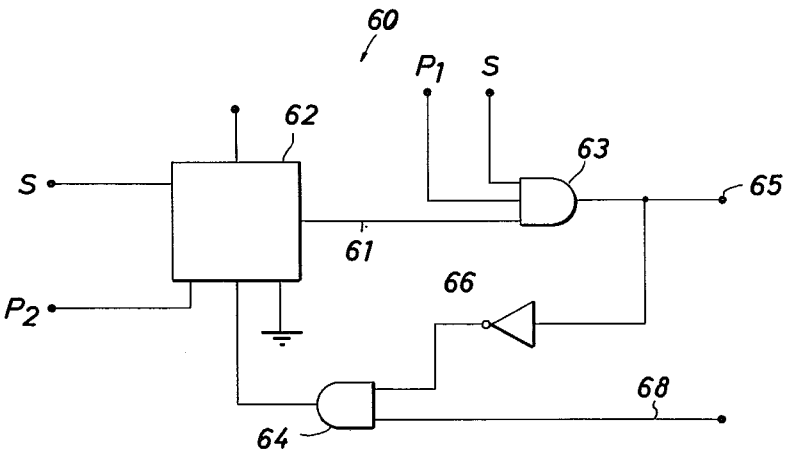
FIG. 7 is a diagram of the duration discriminator circuit.

Clock and control logic circuit 55 also produces control signals $P_1$ and $P_2$, which control duration discriminator 60. Duration discriminator 60, the circuitry of which is shown in FIG. 7, functions to reject any output from shift register delay 52 that is less than two clock cyles in duration, and to prevent recycling of valve 39 within a control deadtime interval, which is set by control one-shot 70. Duration discriminator 60 eliminates or reduces spurious behavior in the system. Control signal $P_1$ is produced by combining the outputs of oscillator 54 and ripple counter 60 through AND gate 56 and is true during the second quarter of the clock cycle. Control signal $P_2$ is produced by passing the output of ripple counter 60 through inverter 59 and combining the outputs of inverter 59 and oscillator 54 through AND gate 57. Control signal $P_2$ is true during the fourth quarter of the clock cycle. If the signal S from shift register delay 52 is true, then the output 61 of flip-flop 62 goes true when flip-flop 62 is clocked by control signal $P_2$. Output 61 true means that S was true in the current clock cycle. If S stays true in the next clock cycle, a trigger pulse is supplied to valve one-shot 69 and control one-shot 70 through AND gate 63. The reset of flip-flop 62 occurs in two ways. Flip-flop 62 will be clocked to the reset state by $P_2$ if S is false, or it will be reset and held in that state by the output of AND gate 64. AND gate 64 couples the output 68 of control one-shot 70 to the reset input of flip-flop 62. The connection from control one-shot 70 input 65 to AND gate 64 via an inverter 66 delays the reset of flip-flop 62 until the end of the triger pulse of control one-shot 70, i.e. the end of $P_1$. The forced reset inhibits retriggering for the duration of the control deadtime, which is substantially equal to the amount of time that a clod spends over a coil 26.

If control one-shot 70 is triggered, it will produce a pulse of controlled preselected duration, which is the control deadtime. The leading edge of the output of control one-shot 70 triggers valve one-shot 69, which supplies a pulse of a preselected duration to valve driver 68. The output of control one-shot 70 also supplies an inhibit signal to duration discriminator 60.

Valve driver 68 amplifies the signal from valve one-shot 69 and supplies current to operate solenoid valve 39. At the end of the signal produced by valve one-shot 69, the current to solenoid valve 39 is terminated and finger 36 again becomes flaccid. It will of course be recognized that the mechanical elements of the apparatus are not as responsive and will not operate as quickly as the electronic elements. For example, the operation of valve 39 and the inflation and deflation of finger 36 will be delayed for some period of time after they are signaled to operate. However, the delay can be minimized by using a quick operating valve and by minimizing the volume of finger 36. Additionally, the mechanical delays can be determined and electronic delays can be designed accordingly.

In operation, the apparatus of the present invention may be either incorporated in a potato harvesting machine, or located in a warehouse or packing facility remote from the field. A supply of potatoes and clods are deposited upon belt 11 either by belt 30 or by some other means. The potatoes and clods are spread randomly across the width of belt 11 and moved at substantially constant speed toward forward end 22. Potatoes, which do not significantly affect the field of magnet 25, leave forward end 22 and travel along trajectory 44 to be received on belt 12. Clods, in contrast, cause the field of magnet 25 to vary and induce a current in coil 26.

The output from coil 26 is amplified by amplifier 50, which has a narrow pass band to attenuate frequencies outside the rather narrow range of frequencies expected for clods. If the output from amplifier 50 exceeds a certain amplitude, amplitude discriminator 51 supplies a pulse to shift register delay 52. Shift register delay 52 delays the stiffening of fingers 36 during the time needed for the clod to travel between detector 13 and rejector 14. The output of shift register delay 52 is received by duration discriminator 60, which eliminates signals of less than a certain preselected duration, which are considered to be spurious. The output of duration discriminator 60 is supplied to control one-shot 70, which actuates valve one-shot 69 and inhibits the reset of duration discriminator 60 during a preselected control deadtime. Valve one-shot 69 operates valve driver 68 which supplies current to solenoid valve 39. When solenoid valve 39 opens, air from manifold 35 enters a finger 36 causing it to become stiff. The stiffness of finger 36 deflects downwardly the trajectory of a clod along the path 45, thereby causing the clod to miss belt 12.

Further modification and alternative embodiments of the apparatus and method of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be taken in the shape, size and arrangement of parts. For example, equivalent elements or materials may be substituted for those illustrated and described herein, parts may be reversed, and certain features of the invention may be utilized independently of the use of other features, all as would be apparent to one skilled in the art after having the benefit of the description of the invention.

What is claimed is:

1. Method for separating clods and the like from potatoes, which comprises the steps of:

creating a magnetic field;

positioning a coil in said magnetic field;

conveying said clods and potatoes through said magnetic field;

detecting the signal induced in said coil by a clod conveyed through said magnetic field;

removing said clods from said potatoes in response to said signal.

2. The method as claimed in claim 1, wherein said conveying step includes the steps of:

positioning said clods and potatoes on a first belt having a forward end;

and driving said belt at a substantially constant speed toward said forward end.

3. The method as claimed in claim 2, wherein said conveying step further includes the steps of:

positioning a second belt spaced horizontally apart from and vertically lower than said forward end that potatoes leaving said forward end land on said second belt.

4. The method as claimed in claim 3, wherein said removing step includes the steps of:

positioning a normally flaccid inflatable finger between said first belt and said second belt in the trajectory of potatoes and clods traveling therebetween;

and inflating said finger in response to said signal.

5. The method as claimed in claim 4, including the step of:

deflating said finger subsequent to said inflating step.

6. The method as claimed in claim 4, including the further step of:

delaying the inflation of said finger for a predetermined period of time after the detection of said clod, said period of time bein substantially equal to the time required for said clod to travel from the point of detection to said finger.

7. Method for separating clods and the like from potatoes, which comprises:

supporting said clods and potatoes on a first belt having a forward end;

driving said first belt at a substantially constant speed to convey said potatoes and clods toward said forward end;

positioning a second belt spaced horizontally apart from and vertically lower than said forward end such that potatoes and clods leaving said forward end travel in a trajectory to land on said second belt;

positioning in a line perpendicular to the direction of travel of said first belt a plurality of spaced apart normally flaccid fingers between said first and second belts in the trajectory of said potatoes and clods;

locating a magnet having a length substantially equal to the width of said first belt beneath said first belt;

spacing a plurality of coils between said magnet and said belt, there being as many coils as there are fingers and the spacing of said coils being substantially equal to the spacing of said fingers;

and inflating one of said fingers in response to a signal induced in one of said coils, whereby said one finger becomes stiff and deflects the trajectory of said clod such that said clod falls between said forward end and said belt.

* * * * *